United States Patent [19]

Petro

[11] Patent Number: 4,519,420

[45] **Date of Patent: * May 28, 1985**

[54] HYDRAULIC VALVES

[75] Inventor: John D. Petro, Hubbard, Ohio

[73] Assignee: Commercial Shearing, Inc., Youngstown, Ohio

[ * ] Notice: The portion of the term of this patent subsequent to May 28, 2002 has been disclaimed.

[21] Appl. No.: 428,255

[22] Filed: Sep. 29, 1982

[51] Int. Cl.[3] ..... F15B 13/04; F15B 13/08

[52] U.S. Cl. ..... 137/596; 91/446; 91/531; 137/269; 137/596.13

[58] Field of Search ..... 91/446, 516, 518, 531; 137/596, 596.13, 269, 271

[56] References Cited

U.S. PATENT DOCUMENTS 4,352,375 10/1982 Williams ..... 137/596.13
4,361,169 11/1982 Williams ..... 137/596.13

*Primary Examiner*—Gerald A. Michalsky
*Attorney, Agent, or Firm*—Buell, Ziesenheim, Beck & Alstadt

[57] ABSTRACT

A hydraulic valve is provided which can be modified to provide priority compensation, parallel pressure compensation, inlet check functions and a float function by changing a flow through inlet valve portion in the inlet chamber of the valve.

9 Claims, 5 Drawing Figures

HYDRAULIC VALVES

This invention relates to hydraulic valves and particularly to a valve structure which can provide priority compensation, parallel pressure compensation and inlet check functions and a float function by simply changing a flow through inlet valve portion in the valve body.

Flow and/or pressure compensation in hydraulic systems is quite old and well-known. In general, however, the valves necessary to provide adequate compensation are complex, generally they require hollow spools and universally they require different valve configurations in at least one of the housings or the main spool in order to accomplish each of these functions. For example, typical prior art compensated valves are shown in Hodgson Pat. Nos. 3,565,110, 3,707,988 and 3,782,404. Similar prior art compensated valves are shown in Conrad Pat. No. 2,671,466 and Rue British Pat. No. 256,786.

In every case, the valve and housing both are complex and require complex porting, chambering and passage formation. Generally, it is difficult to provide a float function in such valves because of their complexity, particularly in the spool structure involved. The present invention eliminates these problems and makes it possible to use either a solid spool or a very simple hollow spool with a relatively simple six core housing to provide any of priority compensation, parallel pressure compensation, inlet check and float functions.

The invention provides an elongate valve body having a longitudinal bore, a spool movable in said bore longitudinally thereof, a fluid inlet chamber in said body, a fluid transfer chamber adjacent said inlet chamber, a pair of spaced work chambers in said body on opposite sides of said inlet and transfer chambers, a pair of exhaust or return chambers in said body on opposite sides of said work chambers, said chambers all intersecting the longitudinal bore in spaced apart positions such that in one position of the spool one work chamber and inlet chamber are in communication and the opposite work chamber is in communication with the adjacent exhaust chambers, a second position wherein the said one work chamber is in communication with the adjacent return chamber and the opposite work chamber is in communication with the inlet chamber through the transfer chamber and a third position in which the two work chambers are in communication with the adjacent return or exhaust chambers, a transverse through flow passage or bore intersecting the inlet chamber adjacent but spaced from the longitudinal bore and extending from one side to the other of the valve body, a pressure responsive valve in said through passage normally extending through said inlet chamber, and a pair of radially inwardly extending lands in said through passage, one on each side of the inlet chamber cooperating with said pressure responsive valve to provide selectively priority compensation, parallel compensation and check functions. Preferably I provide a valve body having an inlet chamber, an adjacent transfer chamber, a pair of work chambers one on each side of the inlet chamber and transfer chamber and a pair of return chambers, one on each side of the work chambers, all said chambers intersecting a longitudinal bore in said body, a spool in said bore movable longitudinally therein from a neutral position in which all chambers are sealed from each other to a first position in which one work chamber and the inlet chamber are in communication and the work chamber and return chamber on the opposite side of the inlet chamber are in communication, a second position where the other work chamber and inlet chamber are in communication through the transfer chamber and the said one work chamber is in communication with the adjacent return chamber, and a third position in which the two work chambers and the adjacent return chambers are in communication to provide a float function, said spool having a plurality of spaced annular grooves cooperating with said chambers, a transverse through flow chamber extending from one side of the body to the other and intersecting the inlet chamber but spaced from the bore, a pressure responsive valve movable axially in said through passage normally extending through said inlet chamber, a pair of radially inwardly extending annular lands in said through passage, one on each side of the inlet chamber, cooperating with said pressure responsive valve to provide selectively priority compensation, parallel compensation and check valve functions, an annular stop ring on said valve bearing against the land nearest the inlet of the through passage, signal passage means communicating from said through passage to the area between said annular ring and land nearest the inlet of said through passage and signal passage means in the housing communicating from the area between at least one work chamber and the adjacent exhaust chamber and the area behind said annular ring opposite the said land nearest the entry end of said through passage whereby the pressure responsive valve is positioned in the through passage relatively to the pressure drop between the secondary parallel path and the work port.

In the foregoing general description of this invention I have set out certain objects, purposes and advantages of the invention. Other objects, purposes and advantages will be apparent from a consideration of the following description and the accompanying drawings in which.

Figure 1:
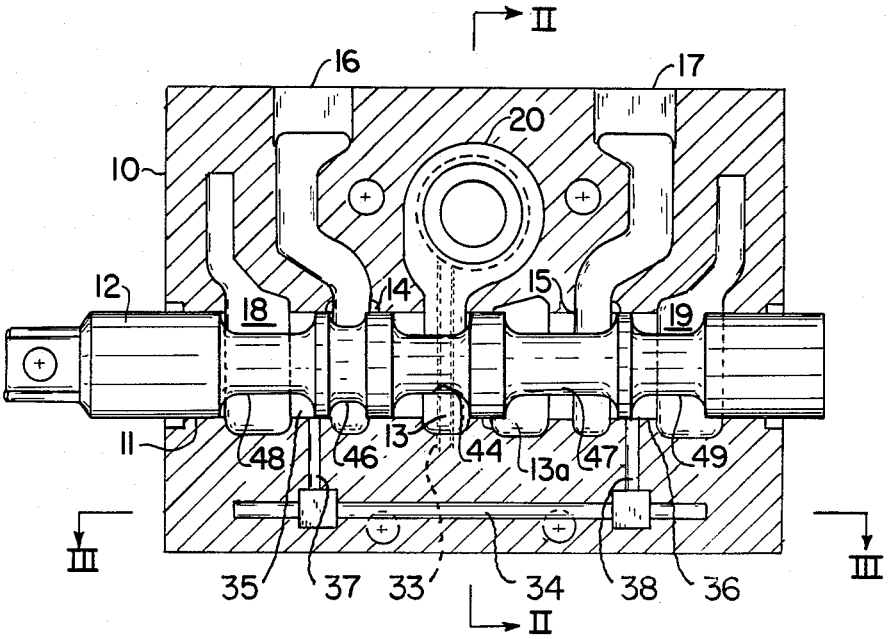
FIG. 1 is a longitudinal section through a parallel compensated load sensing valve with float according to this invention.

Referring to the drawings I have illustrated a housing 10 having an elongate passage or bore 11 and a spool 12 movable longitudinally of the bore. An inlet chamber 13 intersects bore 11 intermediate its ends and a transfer chamber 13*a* is provided adjacent the inlet chamber, both of which lie between two work chambers 14 and 15 which intersect bore 11 and connect the work ports 16 and 17. Exhaust chambers 18 and 19 intersect bore 11 on opposite sides of work chambers 14 and 15. A through passage or bore 20 passes transversely through housing 10 intersecting inlet chamber 13 spaced above bore 12. A pair of annular lands 21 and 22 extend radially inwardly on opposite sides of chamber 13 in passage 20. A check and individual compensator spool 23 is slidable in bore 20 through lands 21 and 22. Spool 23 has an annular radial external ring or land 24 which slides in bore 20 on the inlet side 25 thereof and is normally urged against land 21 by spring 26 held in place by retainer 27. The opposite end of spool 23 has a groove 28, normally open to bore 20 on the exhaust or outlet end 29 thereof and adapted when moved to the left, viewing FIG. 2, to connect the outlet end 29 of bore 20 with inlet chamber 13. A first signal passage 30, 31 and 32 connects the outlet end of bore 20 at land 22 with the inlet end 25 of bore 20 between land 21 and ring 24. A second signal passage 33 connects the inlet end 25 of bore 20 adjacent retainer ring 27 and at an area 24*a* on the opposite side of annular ring 24 from land 21 with a longitudinal signal passage 34 which connects to bore 11 at lands 35 and 36 between the two work passages 14 and 15 and the adjacent exhaust passages 18 and 19 through passages 37 and 38. Bore 34 is intersected adjacent each end by two transverse signal passages 39 and 40 which extend through housing 10 from one side to the other to connect to like passages on next adjacent valve units. A pair of check valves 41 and 42 are provided, one at each end of bore 34, between passage 37 and passage 39 and passage 38 and passage 40. In addition a check valve 43 is provided in bore 34 between passage 33*a* and passages 37 and 38.

The spool 12 is provided with a central groove 44 which, in neutral position, is wholly within chamber 13 and a portion of bore 11 on each side, a narrow groove 46 and a wide groove 47 on opposite sides of groove 44 which, in neutral position are so spaced that groove 46 is wholly within work chamber 14 and groove 47 embraces transfer chambers 13*a* and work chamber 15 and finally a pair of grooves 48 and 49 on opposite sides of grooves 46 and 47. Grooves 48 and 49 are in the neutral position within exhaust chambers 18 and 19 and extend into bore 11 over lands 35 and 36 sufficiently to communicate with passages 37 and 38 and thus with bore 34.

Figure 2:
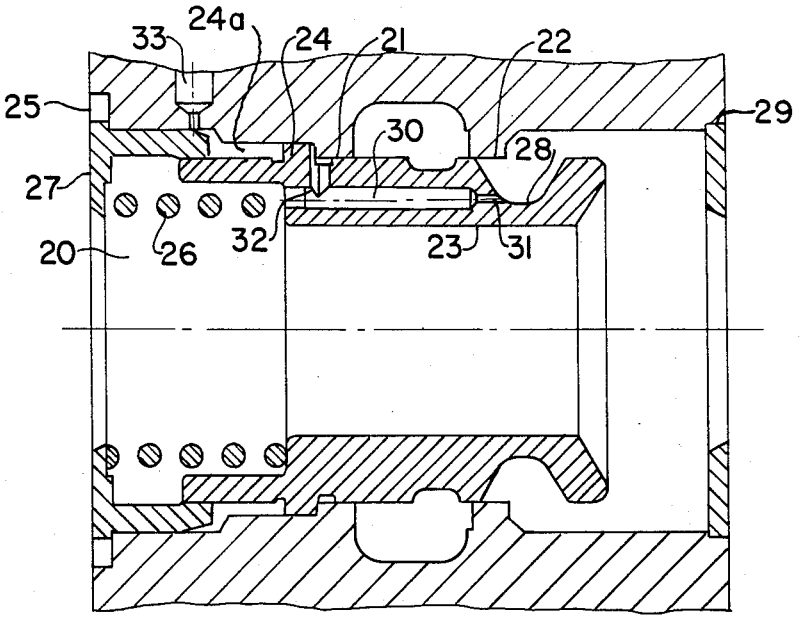
FIG. 2 is a transverse section on the line II—II of FIG. 1.
Figure 3:
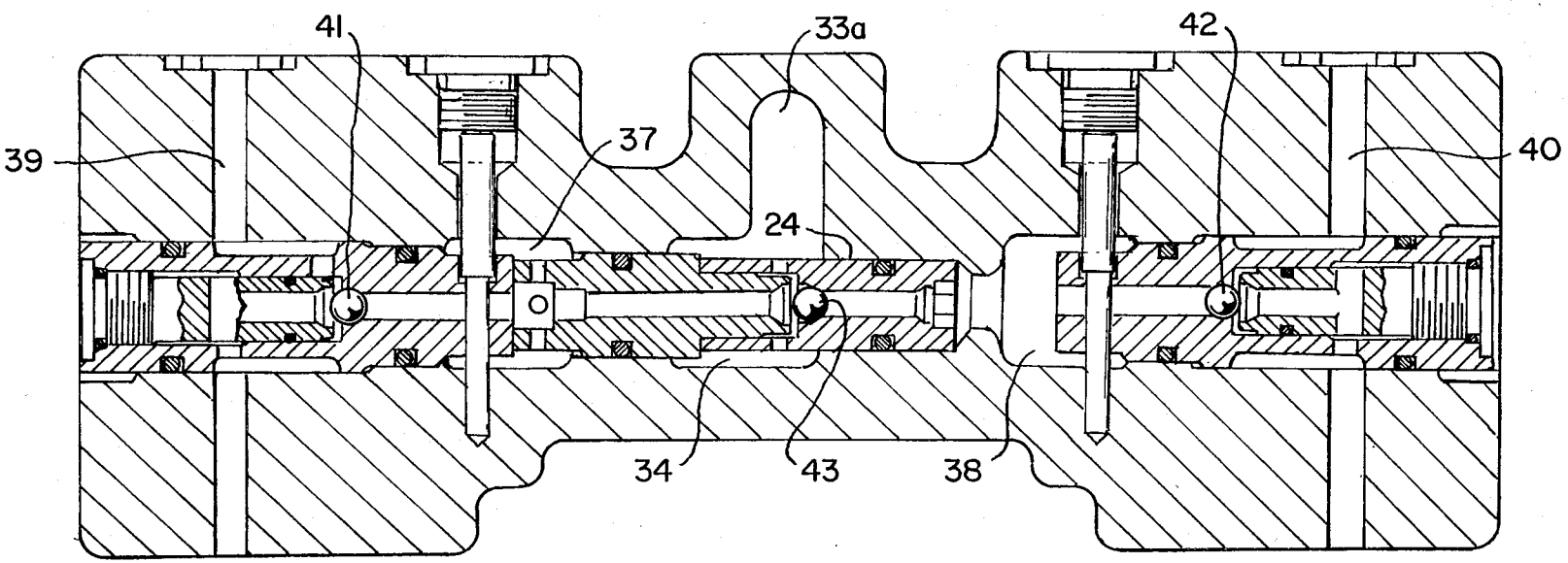
FIG. 3 is a section on the line III—III of FIG. 1.

The valve illustrated in FIGS. 1–3 includes a parallel compensated load sensing valve 23. In operation, the valve works as follows: With the spool in neutral position as shown, fluid from a source of pressure (e.g., a pump not shown) enters inlet end 25 of passage 20 and passes directly through valve 23 and out outlet end 29 of bore 20 to a next succeeding valve, not shown. When the spool 12 is moved to the right viewing FIG. 1 so that groove 44 in spool 12 connects inlet chamber 13 with work chamber 15, then groove 48 connects work chamber 14 with exhaust chamber 18 and through passage 37 with bore 34. Bore 34 is connected through passage 33 with area 24*a* and thus area 24*a* is pressurized to the low pressure of exhaust chamber 14, whereas the area served by signal passage 30, 31 and 32 is pressurized by the pump pressure in bore 20 in front of outlet sleeve 29*a* which overcomes spring 26 and moves valve 23 to the left viewing FIG. 1 and connects bore 20 through groove 28 with inlet chamber 13. This in turn provides pressure fluid to work chamber 15. In a 500 lbs. maximum pressure system, valve 23 will start to shift at approximately 30 lbs. of pilot pressure and will be shifted to full work position at approximately 350 lbs. pilot pressure. A drop in pilot pressure is reflected in a change in compensated valve 25 position. When shifted to the float position exhaust chamber 18 and adjacent work chamber 14 are connected through spool groove 48 and exhaust chamber 19 and work chamber 15 being connected through grooves 47 and 49. In this position the work chambers are thus both connected to exhaust and the work device controlled by them is free to move in any direction.

Figure 4:
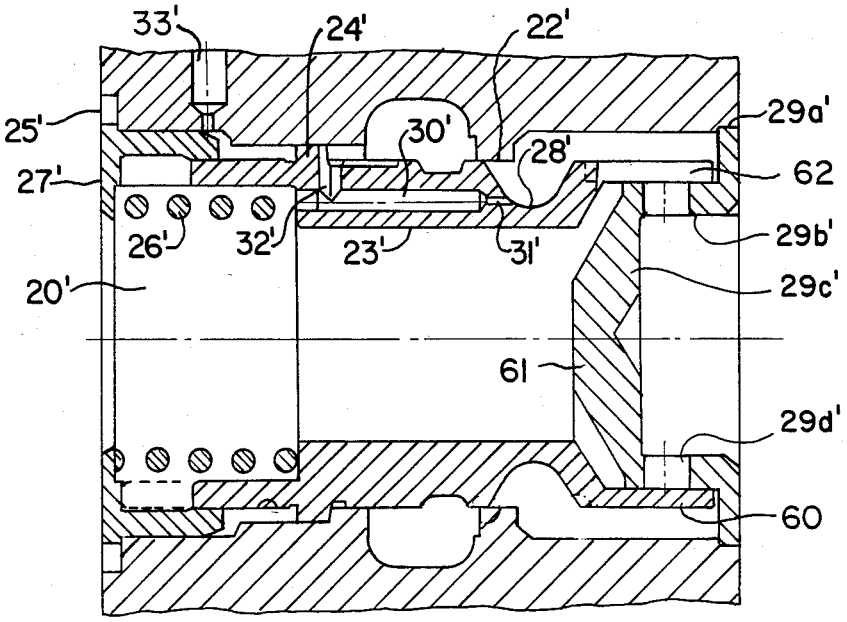
FIG. 4 is a transverse section similar to that of FIG. 2 of a second embodiment showing a like valve structure using a cascade form of in-line spool with float.

In FIG. 4 I have illustrated the same basic valve as shown in FIGS. 1 through 3 with like identifying numerals having a prime suffix but with a cascade form of spool 23′ substituted for the parallel compensator spool 23 and a different form of outlet sleeve 29*a*′ having an inwardly extending cylindrical body 29*b*′ with a closed end 29*c* and radial openings 29*d*′. In this form of valve arrangement spool 23′ carries an skirt 60 which slidingly surrounds a closed cylindrical stub end 61 on outlet sleeve 29*a*′ so as to normally close the outlet end of transverse bore 20′. The skirt 60 is provided with radial passages 62 which are normally partially covered by stub end 61 but permit passage of a small amount of pressure fluid into bore 20′ and groove 28′ and thence to passage 30′, 31′ and 32′ to act on annular ring 24′ precisely as in FIG. 1. As pressure increases in bore 20′ the valve spool 23′ moves to the left and fluid passes through groove 28′ under land 22′ into inlet chamber 13′. When inlet chamber 13′ is satisfied the spool 23′ continues to move to the left until radial passages 63 are exposed in the sidewalls of stub end 61 whereupon fluid flows through them to the next valve in line. This provides a cascade or priority type valving arrangement. The float function operates as described above in connection with FIG. 1.

Figure 5:
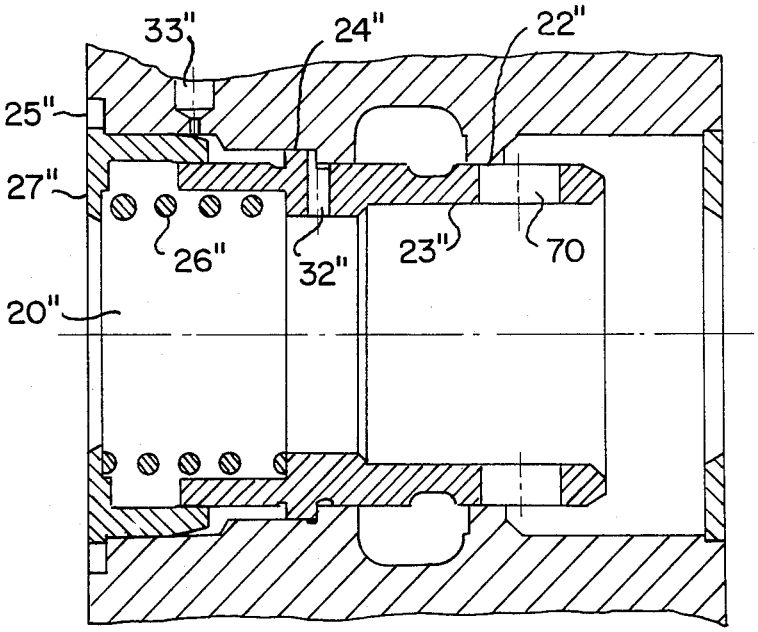
FIG. 5 is a transverse section similar to that of FIG. 2 of a third embodiment showing a like valve structure with a parallel passage check in-line spool with float.

In FIG. 5 I have illustrated a parallel passage check valve in the same basic valve as shown in FIGS. 1 through 3 with like identifying numerals but have a double prime suffix and with a simple parallel check valve form of spool 23″ substituted for the parallel compensator spool 23. In this form of valve arrangement spool 23″ does not have groove 28 as in spool 23 of FIGS. 1–3, but has a plurality of radial passages 70 in the same position lengthwise of the spool so that passage 20″ is open to the interior of spool 23″ through passages 70. When pressurized, spool 23″ moves to the left permitting the flow of fluid from the interior of spool 23″ through passages 70 into inlet chamber 13″ beneath land 22″. If the pressure in spool 23″ drops, the spool 23″ is moved to the right closing inlet chamber 13″ from bore 20″. The float function is as in FIG. 1.

In the foregoing specification I have set out certain preferred practices and embodiments of my invention, however, it will be understood that this invention may be otherwise embodied within the scope of the following claims.

I claim:

1. A hydraulic valve comprising a valve body having a fluid inlet chamber, a fluid transfer chamber on one side of said inlet chamber, a pair of work chambers arranged on opposite sides of said inlet and transfer chambers to deliver fluid to a consumer of hydraulic fluid, a pair of exhaust chambers on opposite sides of said work chambers receiving fluid from the consumer of hydraulic fluid, a longitudinal bore in said valve body intersecting said chambers, a spool in said bore arranged so that in one position one work chamber is in communication with the inlet chamber and sealed from the adjacent exhaust chamber and the other work chamber is in communication with the adjacent exhaust chamber, in a second position the said one work chamber is in communication with the adjacent exhaust chamber and sealed from the inlet chamber and the other work chamber is in communication with the inlet chamber through the transfer chamber and in a third position in which the two work chambers are connected to their adjacent exhaust chambers, a transverse bore in the valve housing communicating with said inlet chamber spaced from the longitudinal bore, a hollow valve spool movable in said transverse bore, a resilient biasing means urging said hollow spool to a position closing said inlet chamber from said transverse bore, an annular external radial pressure area intermediate the ends of said hollow spool, first signal passage means communicating from the area between said at least one work chamber and the adjacent exhaust chamber in a work position of the spool and one side of said radial pressure area whereby to supplement the pressure of said resilient biasing means, a second signal passage means communicating between the transverse bore and the opposite side of said radial pressure area acting to oppose said resilient biasing means and supplemental pressure and outlet sleeve means in the end of the transverse bore opposite the resilient biasing means.

2. A valve as claimed in claim 1 wherein said second signal passage means includes a passage in said hollow spool.

3. A valve as claimed in claim 1 or 2 wherein said hollow spool is one of a parallel compensated spool, a cascade spool and a parallel check spool.

4. A valve as claimed in claim 3 wherein said hollow spool is a cascade spool having an external annular groove adjacent the end remote from the inlet chamber, said groove normally connecting said second signal passage and the transverse bore and on movement toward the inlet chamber communicating with both the inlet chamber and second signal passage, a cylindrical skirt on said spool extending from said groove toward the outlet sleeve, a closed end cylindrical stub on said outlet sleeve extending into and in sliding sealing contact with the skirt on said spool, a plurality of radial openings in the wall of said closed cylinder, normally closed by said skirt, and a plurality of radial openings in said skirt normally partly closed by said stub cylinder.

5. A valve as claimed in claim 1 wherein said hollow spool has an annular external ring adjacent the inlet end of said spool providing two opposed radial pressure areas, one in communication with said first signal passage means, the other in communication with the second passage means, a pair of spaced annular lands in the transverse bore on opposite sides of the inlet chamber, said second signal passage means communicating from the land remote from the annular ring on the hollow spool to a point between the other land and the ring on the spool and passage means on the spool delivering fluid from the transverse bore to said second signal passage.

6. A valve as claimed in claim 5 wherein the hollow spool is a parallel compensated spool and said passage means in the spool is an external annular groove adjacent the end remote from the annular ring, said groove normally connecting said second signal passage and the transverse bore and on movement toward the inlet chamber communicating with both the inlet chamber and second signal passage.

7. A valve as claimed in claim 5 wherein the hollow spool is a cascade spool and said passage means in the spool is an external annular groove adjacent the end remote from the annular ring, said groove normally connecting said second signal passage and the transverse bore and on movement toward the inlet chamber communicating with both the inlet chamber and second signal passage, a cylindrical skirt on said spool extending from said groove toward the outlet sleeve, a closed end cylindrical stub on said outlet sleeve extending into and in sliding sealing contact with the skirt on said spool, a plurality of radial openings in the wall of said closed cylinder, normally closed by said skirt, and a plurality of radial openings in said skirt normally partly closed by said stub cylinder.

8. A valve as claimed in claim 5 wherein the hollow spool is a parallel check spool and the passage means in the spool is a plurality of radial openings in the sidewall normally connecting the second signal passage and the transverse bore and on movement toward the inlet chamber communicating with both the inlet chamber and the second signal passage.

9. A valve as claimed in claim 1 wherein said hollow spool is a cascade spool having an external annular groove adjacent the end remote from the inlet chamber, said groove normally connecting said second signal passage and the transverse bore and on movement toward the inlet chamber communicating with both the inlet chamber and second signal passage, a cylindrical skirt on said spool extending from said groove toward the outlet sleeve, a closed end cylindrical stub on said outlet sleeve extending into and in sliding sealing contact with the skirt on said spool, a plurality of radial openings in the wall of said closed cylinder, normally closed by said skirt, and a plurality of radial openings in said skirt normally partly closed by said stub cylinder.

* * * * *

UNITED STATES PATENT AND TRADEMARK OFFICE

CERTIFICATE OF CORRECTION

PATENT NO. : 4,519,420

DATED : May 28, 1985

INVENTOR(S) : JOHN D. PETRO

It is certified that error appears in the above-identified patent and that said Letters Patent is hereby corrected as shown below:

Column 4, line 6, after "an" insert --annular--.

Signed and Sealed this

*Twenty-fourth* Day of *December 1985*

[SEAL]

*Attest:*

DONALD J. QUIGG

*Attesting Officer*

*Commissioner of Patents and Trademarks*